US005921827A

United States Patent [19]

Ichihashi

[11] Patent Number: 5,921,827

[45] Date of Patent: Jul. 13, 1999

[54] OUTBOARD MOTOR

[75] Inventor: Kaoru Ichihashi, Wako, Japan

[73] Assignee: Honda Giken Kogyo Kabushiki Kaisha, Tokyo, Japan

[21] Appl. No.: 08/992,317

[22] Filed: Dec. 17, 1997

[30] Foreign Application Priority Data

Dec. 19, 1996 [JP] Japan ..... 8-339664

[51] Int. Cl.[6] ..... B63H 20/32

[52] U.S. Cl. ..... 440/77; 123/195 P

[58] Field of Search ..... 440/900, 76, 77; 123/195 P

[56] References Cited

U.S. PATENT DOCUMENTS

| | | | |
|---|---|---|---|
| 3,358,668 | 12/1967 | Post et al. | 440/77 |
| 4,698,037 | 10/1987 | Watanabe et al. | 440/76 |
| 4,708,673 | 11/1987 | Dunham et al. | 440/77 |
| 4,800,854 | 1/1989 | Slattery | 123/195 |
| 5,069,643 | 12/1991 | Westberg et al. | 123/195 P |
| 5,360,358 | 11/1994 | Haman | 440/77 |
| 5,715,777 | 2/1998 | Wada et al. | 440/900 |
| 5,722,360 | 3/1998 | Tsunoda et al. | 440/900 |

FOREIGN PATENT DOCUMENTS 8-93546 4/1996 Japan .

*Primary Examiner*—Sherman Basinger
*Assistant Examiner*—Patrick Muldoon
*Attorney, Agent, or Firm*—Merchant & Gould P.C.

[57] ABSTRACT

An outboard motor includes an engine bottom cover member which is disposed in a space between a front portion of an under cover and an upper portion of an outboard motor attachment mechanism and conceals a bottom end portion of an engine from view at least in a lateral direction of the outboard motor. The outboard motor having such concealed engine bottom portion is sightly in appearance. The engine bottom cover member is formed integrally with an under cover and, hence, it can be assembled automatically when the under cover is attached to the under case.

2 Claims, 4 Drawing Sheets

OUTBOARD MOTOR

BACKGROUND OF THE INVENTION

1. Field of the Invention

The present invention relates to the improvements in an outboard motor.

2. Description of the Prior Art

Outboard motors having a vertical engine are known as disclosed, for example, in Japanese Patent Laid-open Publication No. 8-93546 assigned to the present assignee.

The disclosed outboard motor includes an engine, a mount case supporting thereon the engine, an extension case connected to the bottom of the mount case, an under case attached to the mount case, an engine cover attached to the top of the under case, an under cover arranged between the under case and the extension case, and a stern bracket to be attached to the stern of a hull.

With this arrangement, since a lower edge of a front portion of the under case and an upper end of the stern bracket are spaced from each other, a bottom end portion of the engine (formed by a cover surrounding a lower portion of a flywheel) is exposed to view, rendering the outboard motor unsightly in appearance.

SUMMARY OF THE INVENTION

With the foregoing problem in view, it is an object of the present invention to provide an outboard motor which is sightly in appearance.

To attain the foregoing object, an outboard motor according to the present invention includes an engine bottom cover member disposed in a space between a front portion of an under cover and an upper portion of an outboard motor attachment mechanism. The engine bottom cover member conceals a bottom end portion of an engine from view at least in a lateral direction of the outboard motor. The outboard motor having such concealed engine bottom portion is sightly in appearance. Preferably, the engine bottom cover member is formed integrally with an under cover. Due to this integral structure, the engine bottom cover member can be assembled in a desired position automatically when the under cover is attached to the under case. The engine bottom cover member requires no additional assembling process and cost.

The above and other object, features and advantages of the present invention will become manifest to those versed in the art upon making reference to the detailed description and accompanying sheets of drawings in which a preferred structural embodiment incorporating the principles of the present invention is shown by way of illustrative example.

DETAILED DESCRIPTION OF THE INVENTION

One preferred structural embodiment of the present invention will be described below in greater detail with reference to the accompanying sheets of drawings.

Figure 1:
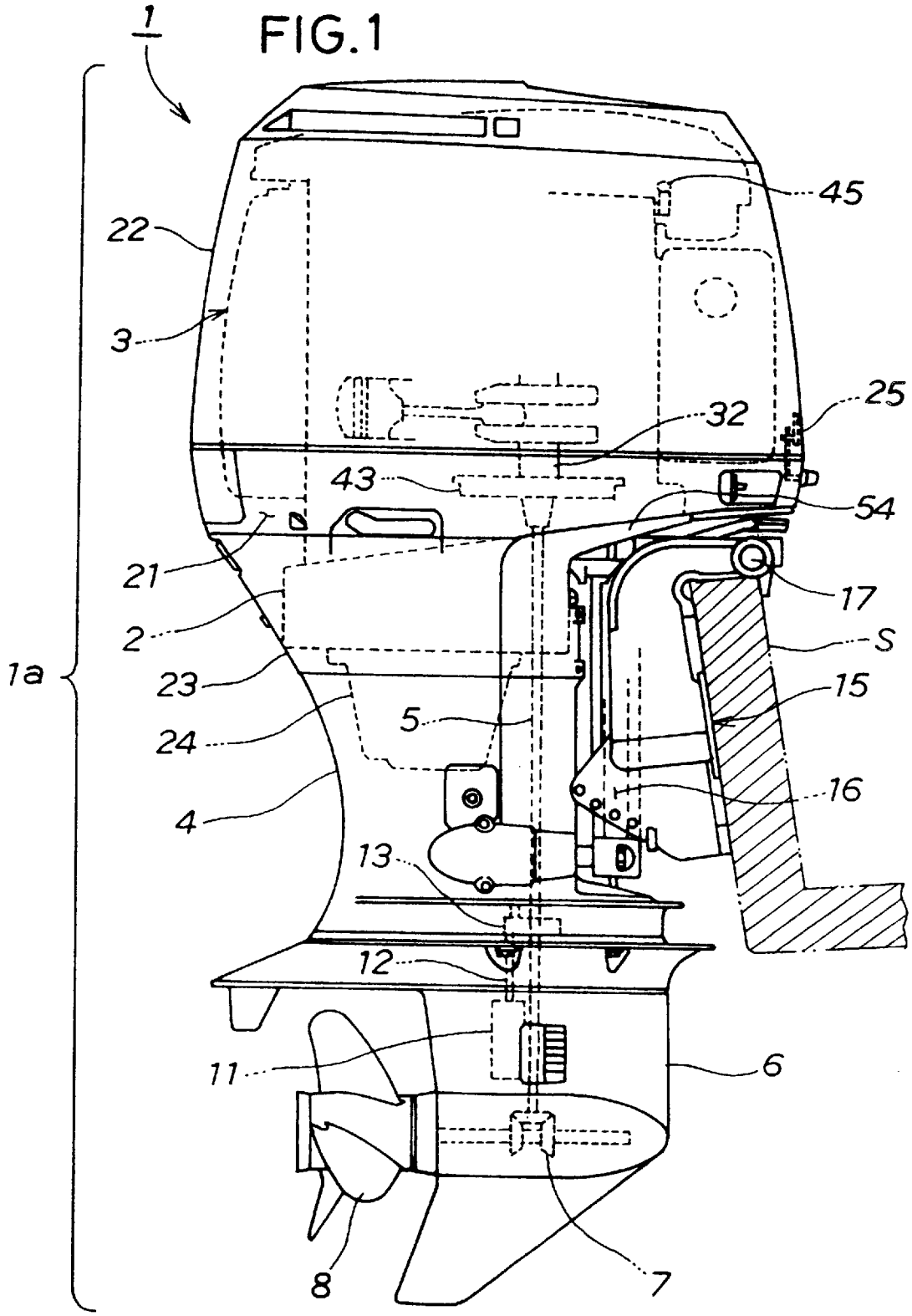
FIG. 1 is a side view of an outboard motor according to the present invention.

Referring now to FIG. 1, there is shown an outboard engine or motor 1 according to the present invention. The outboard motor generally comprises an outboard motor body 1*a* and an outboard motor attachment mechanism 15 for attaching the outboard motor body 1*a* to the stern of a hull S. Throughout the specification, the terms "front" and "rear" are used with reference to the direction of movement of the hull S on which the outboard motor 1 of the present invention is mounted.

The outboard motor body 1*a* includes a mount case (engine support case) 2, a vertical multicylinder engine 3 carried on and bolted to the mount case 2, and an extension case 4 bolted to the bottom of the mount case and defining therein an exhaust expansion chamber. A vertical shaft 5 extends vertically through an internal space of the extension case 4 for transmitting rotational power of the engine 3 to a propeller 8. A gear case 6 is connected to a lower end of the extension case 4 and houses therein a bevel gear set 7 operatively connected with a dog clutch (not shown) for switching or changing over the forward and reverse rotation of the propeller 8 to move the hull S forwardly or backwardly. The bevel gear set 7 has an output shaft to which the propeller 8 is firmly connected so that the propeller 8 is rotatably driven by the engine power transmitted via the vertical drive shaft 5. The gear case 6 also houses a cooling water screen 11 which is connected by a cooling water supply pipe 12 to a water pump 13 disposed in the internal space of the extension case 4.

The outboard motor attachment mechanism 15 is a fixture assembly used for securing the outboard motor body 1*a* to the stern of the hull S, with a mount rubber disposed between the stern and the attachment mechanism 15. The attachment mechanism 15 supports the motor body 1*a* such that the motor body 1*a* can swing in the lateral direction about a vertical swivel shaft 16 and it also able to tilt up and down about a horizontal tilt shaft 17.

The outboard motor body 1*a* further has an under case 21, an engine cover 22 mounted on the under case 21 and cooperating with the latter to receive therein the engine 3, and an under cover 23 disposed directly below the under case 21 and surrounding the mount case 2 and an upper end portion of the extension case 4.

More particularly, the under case 21 is mounted on an upper end portion of the mount case 2 and secured to the latter by a plurality of screws 28 (one being shown in FIG. 2), with a rubber vibration isolator 27 (FIG. 2) disposed between the under case 21 and the mount case 2. The under case 21 and the engine cover 22 are detachably connected together by a lock mechanism 25, with the engine cover 22 carried on the under case 21. The under case 21 has a lower end connected by screws (not shown) to an upper end of the under cover 23. The under case 21 and the engine cover 22 serve as an engine case defining therein an engine room in which the engine 3 is received. The under cover 23 has the function of a decorative or ornamental cover. An oil pan 24 is connected to the bottom of the mount case 2.

Figure 2:
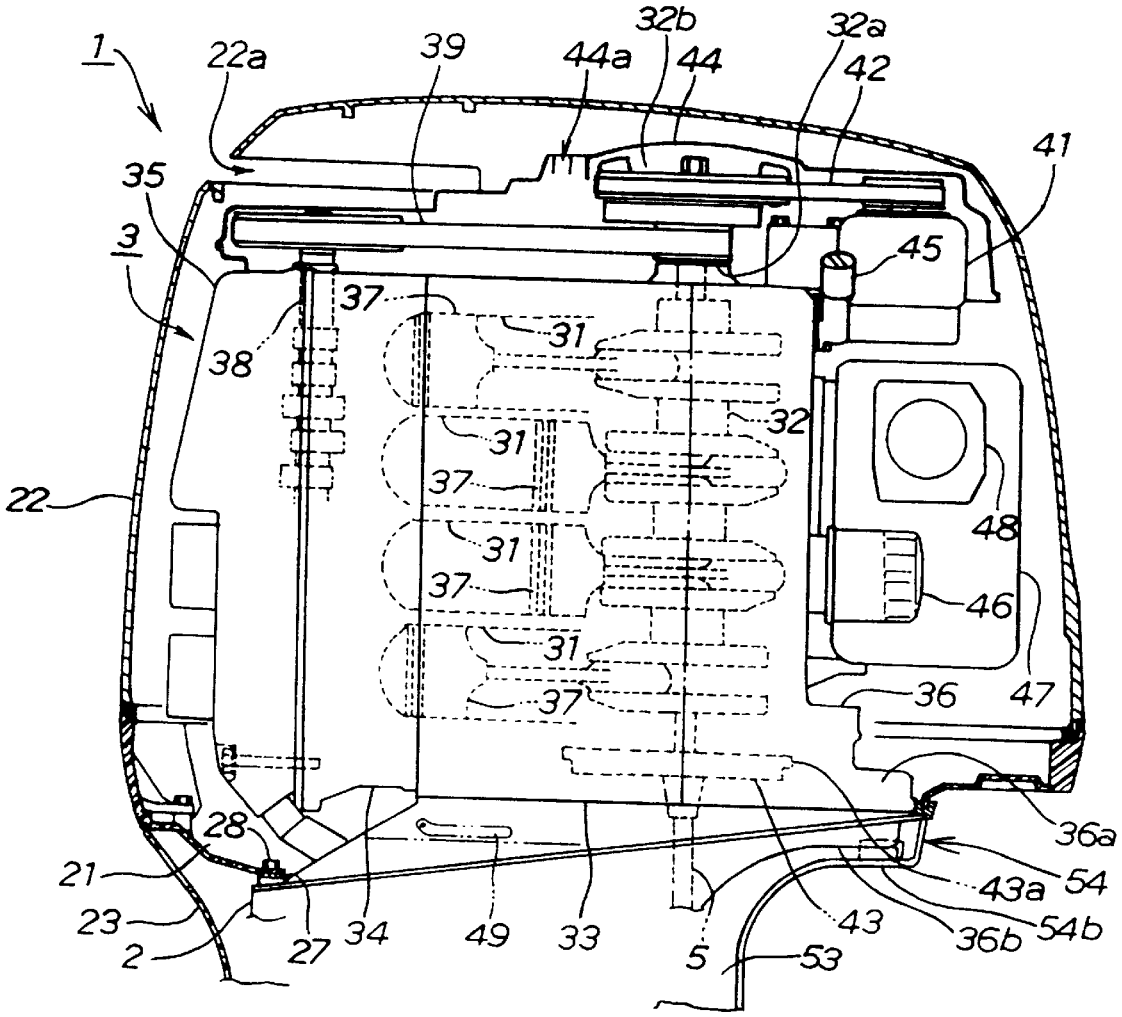
FIG. 2 is a side view of a vertical multicylinder engine of the outboard motor with an engine cover shown in cross section.

As shown in FIG. 2, the vertical multicylinder engine 3 is a four-cylinder four-stroke engine with four vertically arranged cylinders 31 disposed horizontally and a crankshaft 32 disposed vertically. With the engine 3 thus arranged, a cylinder block 33 and a cylinder head 34 have respective contact surfaces (i.e., a mating surface) lying substantially in a vertical plane, and the cylinder head 34 and a head cover 35 have respective contact surfaces (i.e., a mating surface) lying substantially in a vertical plane.

The engine 3 is disposed vertically with its cylinder head 34 and head cover 35 located at the rear side (left-hand side of FIG. 2) of the outboard motor 1. In FIG. 2 designated by 36 is a crankcase bolted to the cylinder block 33, and numeral 37 denotes a piston slidable in each the cylinders 31.

The crankshaft 32 has an upper end to which a first pulley 32*a* and a second pulley 32*b* are connected one behind the other. The crankshaft 32 drives a camshaft 38 via a first endless belt 42 trained around the first pulley 32*a* and a crankshaft pulley (not designated). The crankshaft 32 also drives an alternator 41 via a second endless belt 42 trained around the second pulley 32*b* and an alternator pulley (not designated). The first and second endless belts 39, 42 are covered by a belt cover 44. The belt cover 44 has formed therein a ventilating hole or opening 44*a* through which air inside the belt cover 44 is driven out to the outside of the engine cover 22. The engine cover 22 has an air intake hole 22*a* formed at an upper portion thereof.

The crankshaft 32 has a lower end to which a flywheel 43 with toothed ring 43*a* is attached for engagement with a pinion gear (not shown) on a starter motor (not shown). The flywheel 43 is received in a flywheel housing 36*a* formed at a lower end of the crankcase 36. The flywheel 43 is also covered from below by a flywheel cover 36*b* attached to a lower end of the flywheel housing 36. The flywheel cover 36*b* forming a bottom portion of the engine 3 is concealed from view at least in a lateral direction of the outboard motor 1 by means of an engine bottom cover member 54 described later.

An oil filler hole 45 is provided in an inclined condition at a front surface of the crankcase 36. Reference character 46 denotes an oil filter; 47, an intake silencer defining therein a silencer chamber; 48, a throttle valve device; and 49, an actuator lever for operating a latch mechanism (not shown) used for the detachable mounting of the engine cover 22 relative to the under case 21.

Figure 3:
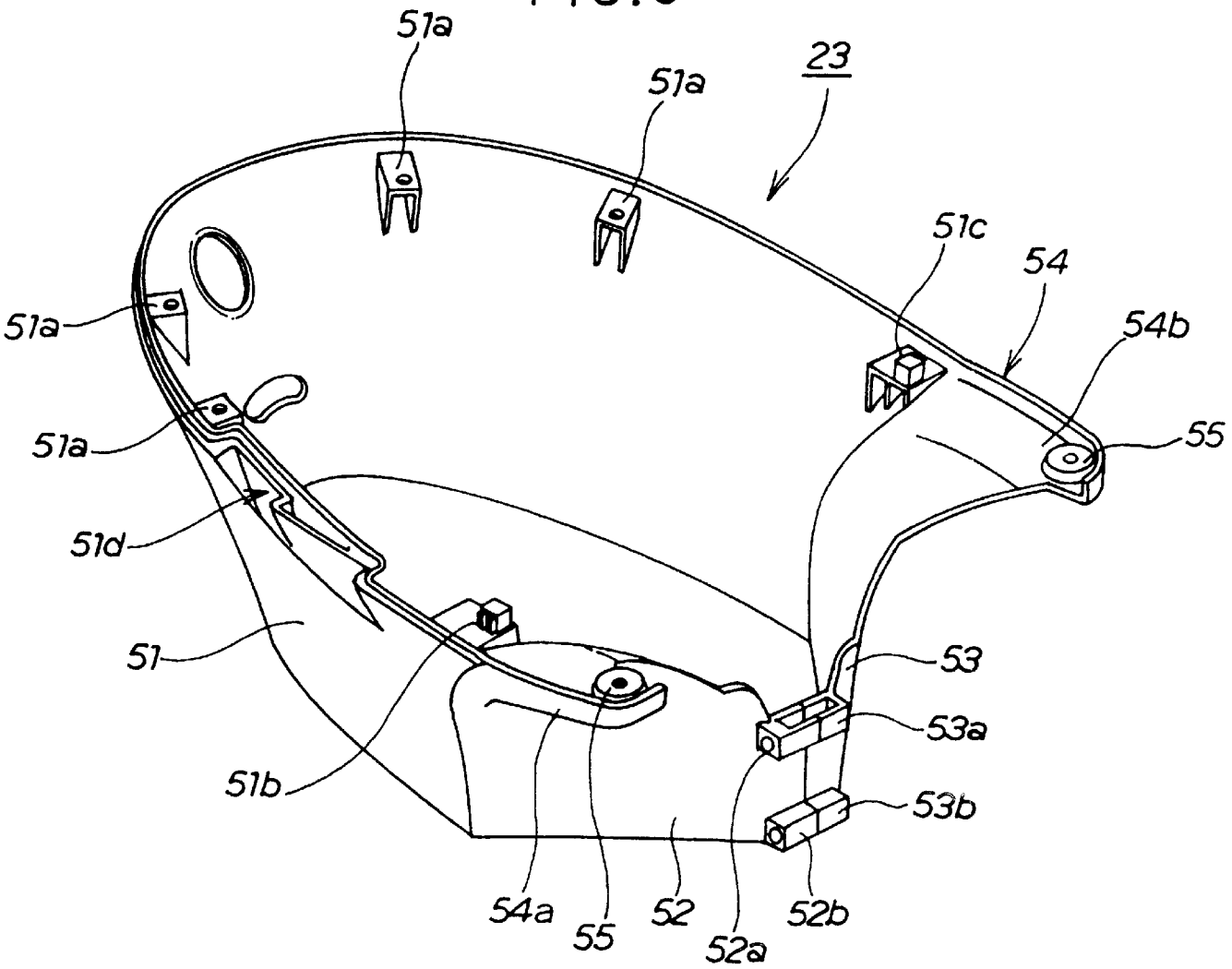
FIG. 3 is a perspective view showing an under cover of the outboard motor.

As shown in FIG. 3, the under cover 23 has a hollow shape and includes a curved peripheral wall portion 51 tapering downwardly and forming a rear wall and opposite sidewalls contiguous to the rear wall, and a pair of front walls 52, 53 extending forwardly and convergently from respective front ends of the sidewalls of the curved wall portion 51. The front walls 52, 53 meet together at their front ends so as to form a front end of the under cover 23. The engine bottom cover member 54 is composed of a pair of wing-like cover portions 54*a*, 54*b* of L-shaped cross section formed as an integral part of the under cover 23 and projecting outwardly from respective upper edges of the front walls 52, 53. The under cover 23 including the engine bottom cover member 54 is molded from a synthetic resin material. It may be press-formed from a sheet metal.

The curved peripheral wall portion 51 has on its inside surface a plurality of attachment ribs 51*a* into which a plurality of screws (not shown) are threaded to join the under cover 23 and the under case 21 (FIGS. 1 and 2), a pair of diametrically opposite positioning projections 51*b* and 51*c* used for positioning the under cover 23 relative to the under case 21 when they are assembled together, and a lateral recess 51*d* provided to insure interference-free movement of the actuator lever 49 relative to the under cover 23 when the actuator lever 49 is operated. The attachment ribs 51*a*, the positioning projections 51*b*, 51*c*, and the lateral recess 51*d* are located adjacent to an upper edge of the curved peripheral wall portion 51.

The front walls 52, 53 each have a pair of vertically spaced attachment ribs 52*a*, 52*b*; 53*a*, 53*b* located at the front edge thereof. The attachment ribs 52*a*, 52*b* on one front wall 52 and the attachment ribs 53*a*, 53*b* on the other front wall 53 are fastened together by means of a pair of screws (not shown) to join these two front walls 52, 53.

The cover portions 54*a*, 54*b* of the engine bottom cover member 54 each have an attachment seat 55 into which a screw (not shown) is threaded to secure the engine bottom cover member 54 to the under case 21 at the time the under cover 23 is connected to the under case 21.

Figure 4:
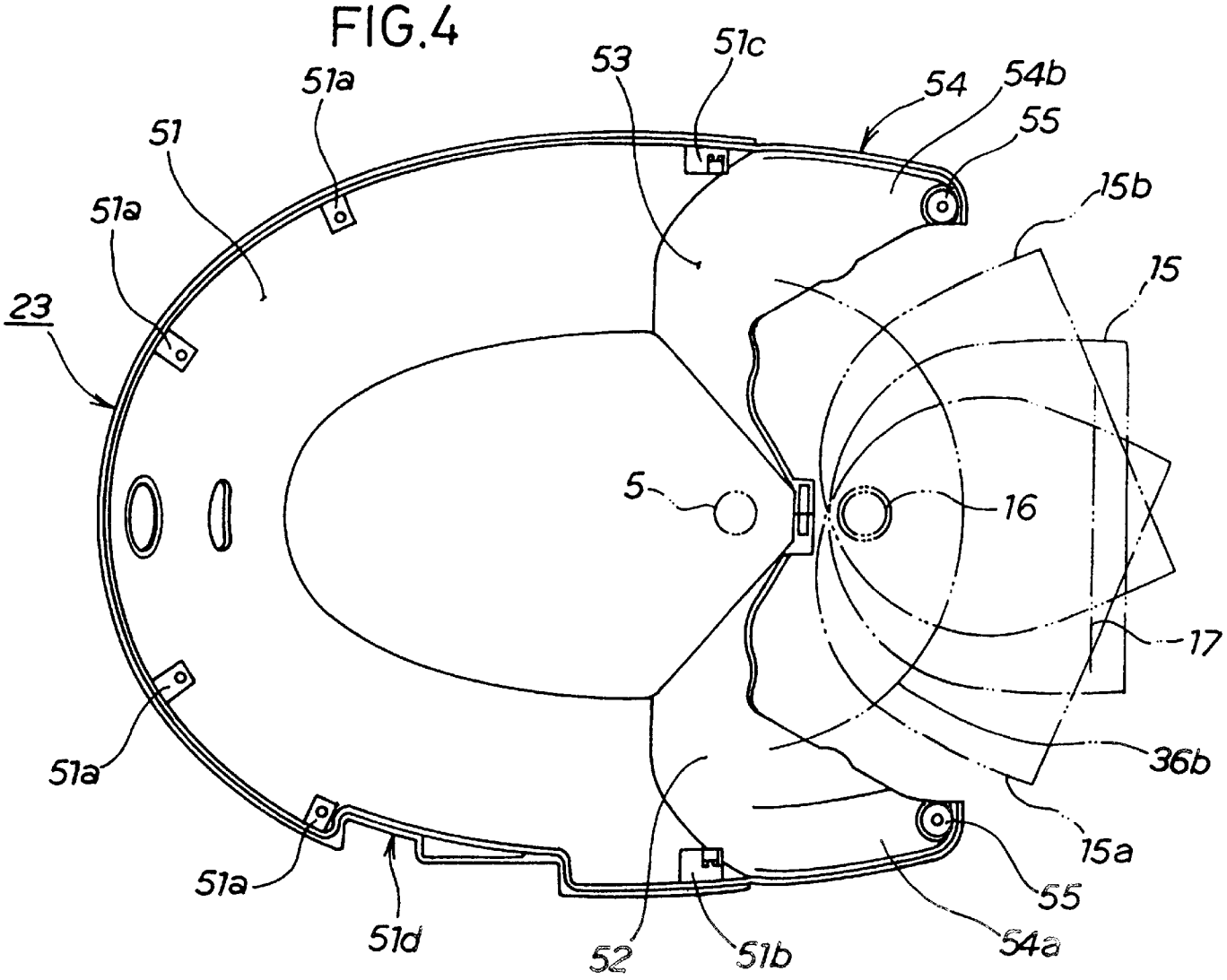
FIG. 4 is a plan view of the under cover.

As shown in FIG. 4, the cover portions 54*a*, 54*b* have a generally trapezoidal shape when viewed from above. The cover portions 54*a*, 54*b* are configured such that they can continuously cover or conceal the flywheel cover 36*b* (forming a bottom portion of the engine 3) from view at least in the lateral direction of the outboard motor 1, without causing interference with the outboard motor attachment mechanism 15, when the outboard motor 1 (FIG. 1) is turned lock-to-lock or swing between prescribed two end extremities of its swivel motion about the swivel shaft 16, as indicated by the phantom lines 15*a* and 15*b* shown in FIG. 4.

By virtue of the engine bottom cover member 54, the bottom portion of the engine 3 (formed by the flywheel cover 36*b*) is concealed from view at least in the lateral direction of the outboard motor 1, and so the outboard motor 1 becomes sightly in appearance. Since the wing-like cover portions 54*a*, 54*b* of the engine bottom cover member 54 are formed integrally with the under cover 23, they can be assembled in a desired position automatically when the under cover 23 and the under case 21 are assembled together. Thus, the engine bottom cover member 54 requires no additional assembling process and cost.

Though not shown, the engine bottom cover member 54 may be formed integrally with the under case 21 in which instance it may comprise a pair of wing-like portions of L-shaped cross section projecting inwardly from a lower end of the under case 21. The engine bottom cover member 54 may be formed by a separate member structurally independent from the under cover 23 or the under case 21. The separate engine bottom cover member 54 may be attached to the under cover 23 or the under case 21 by a suitable fastener such as screws or rivets, or an adhesive including an adhesive tape. The under cover 23 may have a two-piece structure composed of a rear half similar to the rear peripheral wall portion 51 shown in FIG. 3, and a front half similar to a part composed of the two front walls 52, 53 shown in FIG. 3.

Obviously, various minor changes and modifications of the present invention are possible in the light of the above teaching. It is therefore to be understood that within the scope of the appended claims the invention may be practiced otherwise than as specifically described.

What is claimed is:

1. An outboard motor, comprising:

(a) an attachment mechanism attachable to a hull to mount said outboard motor on the hull; and (b) an outboard motor body movably connected to said outboard motor attachment mechanism such that it can swing about a vertical axis and tilt about a horizontal axis relatively to said attachment mechanism, said outboard motor body including (i) an engine, (ii) a mount case supporting thereon said engine, (iii) an under case mounted on an upper portion of said mount case and having a front portion vertically spaced from an upper portion of said outboard motor attachment mechanism, said engine having a bottom portion exposed to view through a space between said front portion of said under case and said upper portion of said outboard motor attachment mechanism, (iv) an engine cover mounted on said under case and covering said engine from above, said engine cover and said under case jointly serving as an engine case defining therein an engine room in which said engine is received, (v) a one-piece under cover disposed directly below said under case, (vi) an extension case disposed below said under cover, and (vii) an engine bottom cover member disposed in said space between said front portion of said under case and said upper portion of said outboard motor attachment mechanism and concealing said bottom portion of said engine from view at least in a lateral direction of said outboard motor, wherein said engine bottom cover member is integral with an upper part of said under cover, said one-piece under cover having a pair of front walls converging with each other to form a front end of said under cover, and said engine bottom cover member having a pair of wing-like cover portions integral with and projecting outwardly from respective upper edges of said front walls of said under cover, each of said wing-like cover portions having an attachment part secured to said under case to attach said engine bottom cover member to said under case.

2. The outboard motor according to claim 1, wherein said engine bottom cover member and said under cover are integrally molded from a synthetic resin material.

* * * * *